United States Patent [19]

Mizuta

[11] Patent Number: 4,725,808

[45] Date of Patent: Feb. 16, 1988

[54] SWITCHING DEVICE EQUIPPED VARIABLE RESISTOR

[75] Inventor: Yukio Mizuta, Aichi, Japan

[73] Assignee: Kabushiki Kaisha Tokai Rika Denki Seisakusho, Aichi, Japan

[21] Appl. No.: 901,518

[22] Filed: Aug. 28, 1986

[30] Foreign Application Priority Data

Aug. 29, 1985 [JP] Japan ..... 60-132343[U]

[51] Int. Cl.[4] ..... H01H 15/00; H01R 13/50

[52] U.S. Cl. ..... 338/176; 338/200; 200/16 R

[58] Field of Search ..... 200/5 R, 5 E, 17 R, 200/18, 61.54, 16 C; 338/176, 179, 200, 215

[56] References Cited

U.S. PATENT DOCUMENTS 3,633,146 1/1972 Sasaki et al. ..... 338/200

3,735,061 5/1973 Byrd ..... 338/200 X 4,408,104 10/1983 Iwata et al. ..... 200/61.54

*Primary Examiner*—J. R. Scott

*Attorney, Agent, or Firm*—Finnegan, Henderson, Farabow, Garrett and Dunner

[57] ABSTRACT

A switching device has employed a linearly operating variable resistor in place of the rotatively operating variable resistor. The switching device comprises a guide shaft and an operating knob rotatably slidably mounted thereon. The knob has an actuating arm extending from the guide shaft which mates with a longitudinal groove of a contact holder. The contact holder is movable between a first and second position by rotation of the operating knob about the guide shaft. An operating element linearly movable relative to the axis of the guide shaft, is mated with the operating knob to move the operating element to selectively adjust the variable resistor.

1 Claim, 6 Drawing Figures

SWITCHING DEVICE EQUIPPED VARIABLE RESISTOR

BACKGROUND OF THE INVENTION

This invention relates to a switching device equipped with a variable resistor and more particularly to a switching device for making or breaking the contacts and operating the variable resistor by means of one and the same operating knob.

A switching device of the sort above mentioned has normally employed a rotatively operating variable resistor, whose operating shaft is made movable in the axial direction with its front end being projected from the body of the variable resistor and used to turn on or off the switching device.

However, a linearly operating variable resistor in place of the rotatively operating variable resistor is sometimes held important for use in equipment. The reason for this is that only a look at the operating knob position makes it possible to readily confirm a set value, i.e., the linearly operating variable resistor is handy to use because its operating knob can provide a relatively large moving stroke. Accordingly, there has been called for the introduction of a switching device equipped with a variable resistor in the form of a combination of a linearly operating variable resistor and a switch mechanism.

Even if it is attempted to adopt the switch mechanism in the above rotatively operating variable resistor in the hope of providing the linearly operating variable resistor with switch functions, the fact that the operating knob has a large moving stroke in view of its mechanical properties still makes such an attempt futile. Actually, no switching device with a variable resistor in the form of the combination of the linearly operating variable resistor and the switch mechanism has yet been introduced.

BRIEF SUMMARY OF THE INVENTION

An object of the present invention is to provide a switching device equipped with a variable resistor and having switch functions by making use of the excellent handy-to-use properties of a linearly operating variable resistor.

The switching device according to the present invention a switching device having a linear variable resistor comprising: a switch case having a bottom surface and sidewalls extending therefrom, and a guide shaft longitudinally mounted in said sidewalls, and an operating knob rotatably mounted on and linearly slidably movable along the guide shaft. The knob has an actuating arm extending substantially perpendicularly relative to said guide shaft. A holder is provided which has a movable contact positioned therein, the holder being movably mounted in the switch case, and a fixed contact positioned below the movable contact in the bottom surface of the switch case. The holder is configured with a longitudinal groove to accomodate the distal end of the actuating arm of the operating knob to permit slidable movement of the actuating arm along the groove. The holder is linearly movable between a first and second position to selectively activate and deactivate the switching device by rotation of the operating knob about the guide shaft. An operating element, linearly movable relative to the central axis of the guide shaft, is provided for selectively adjusting the linear variable resistor; and a coupling means, extending from the operating knob, is provided for mating with the operating element to linearly move the operating element in accordance with the axial position of the operating knob on the guide shaft.

BRIEF DESCRIPTION OF THE DRAWINGS

The accompanying drawings illustrate an embodiment of the present invention.

DETAILED DESCRIPTION

Referring now to the accompanying drawings, a description will be given of an embodiment of the present invention adapted for a wiper switch arranged on an instrument board of a motor vehicle.

Figure 1:
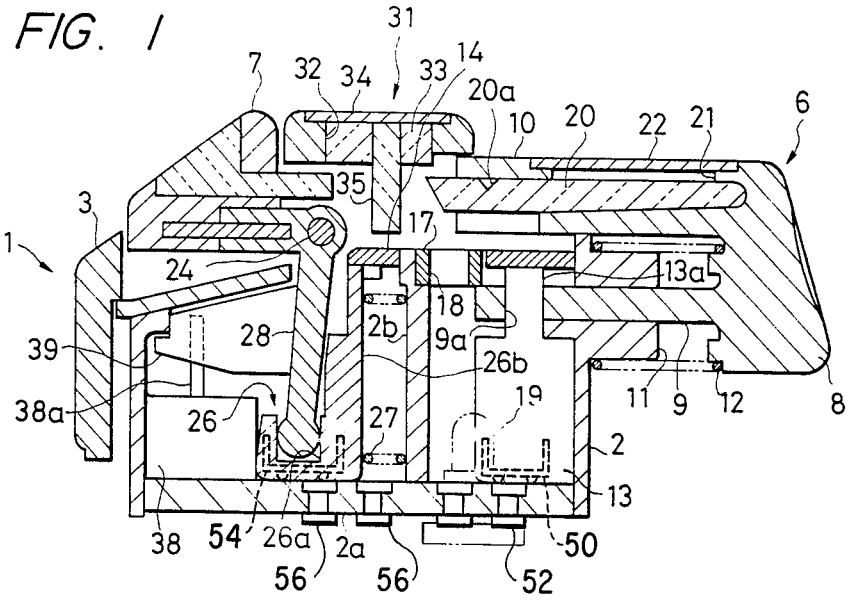
FIG. 1 is a transverse sectional view taken on line I—I of FIG. 2.
Figure 2:
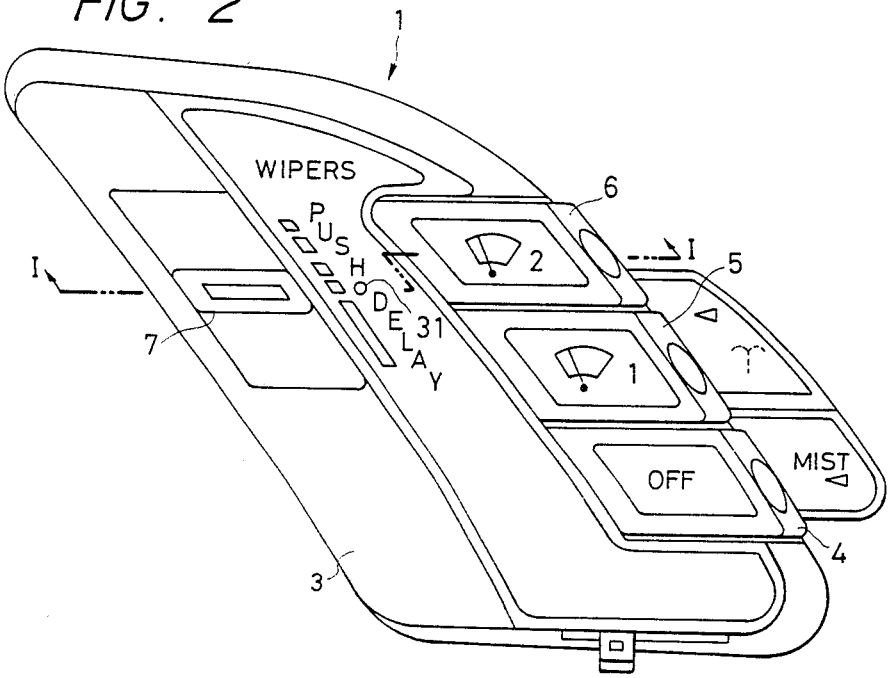
FIG. 2 is an elevational view of the whole body.

In FIGS. 1 and 2, there is shown a wiper switch comprising a switch body 1 formed by covering a switch case 2 with a switch cover 3 and arranged on the right of a steering column (not shown) of a motor vehicle; first through third operating elements 4~6; and an operating knob 7 equivalent to a fourth operating element. Of the operating elements, the first through third operating elements 4~6 that can be pressed toward the left are installed vertically in three tiers on the right of the switch case 2, i.e., the operating elements respectively for OFF, low and high wiper operation are arranged in ascending order. On the other hand, the operating knob 7 is installed on the left of the switch body 1 in such a manner that it can be pressed rearward and also moved upward and downward. When the operating knob 7 is pressed down, an intermittent wiper is operated and the intermittent time interval can be adjusted by moving the knob upward and downward.

Figure 3:
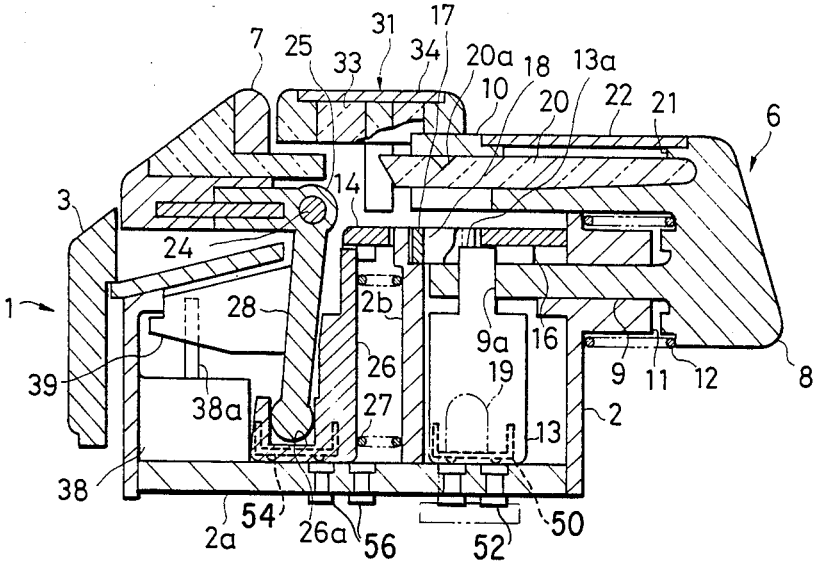
FIG. 3 is a transverse sectional view showing a third operating element held in the depressed state.

The first through third operating elements 4~6 will be described first. As the ways in which the first through third operating elements 4~6 are supported by the switch case 2 are identical, the support structure of the third operating element 6 only will be described by reference to FIG. 1. A mounting lever 9 and a display means 10 are projected from a push means 8 toward the switch case 2 in the third operating element 6, whereas a support tube 11 allowing the mounting lever 9 of the operating element 6 to pass therethrough is formed in the right-hand wall of the switch case 2. The mounting lever 9 is inserted into the support tube 11 of the switch case 2 to make laterally movable the operating element 6, which is normally energized by a compression spring 12 installed between the push means 8 and the outer wall of the switch case 2 in the direction opposite to which manual pressure is applied, i.e., to the right of FIG. 1. Moreover, a mating hole 9*a* is formed in a position close to the front end of the mounting lever 9 and a mating projection 13*a* projected from the upper end of a contact holder 13 installed movably in the lateral direction of the switch case 2 is fitted into the mating hole 9*a*. A moving contact 50 is arranged on the under surface of the contact holder 13 and a fixed contact 52 corresponding to the moving contact is arranged on an insulator plate 2*a* forming the bottom of the switch case 2. When each of the operating elements 4~6 thus supported by the switch case 2 is pressed down against the elastic repulsive force of the compression spring 12, the corresponding contact holder 13 interlockingly moves to the left of FIG. 1 and reaches such a state as shown in FIG. 3, so that the moving and fixed contacts 50 and 52 make contact with each other as prescribed.

Figure 5:
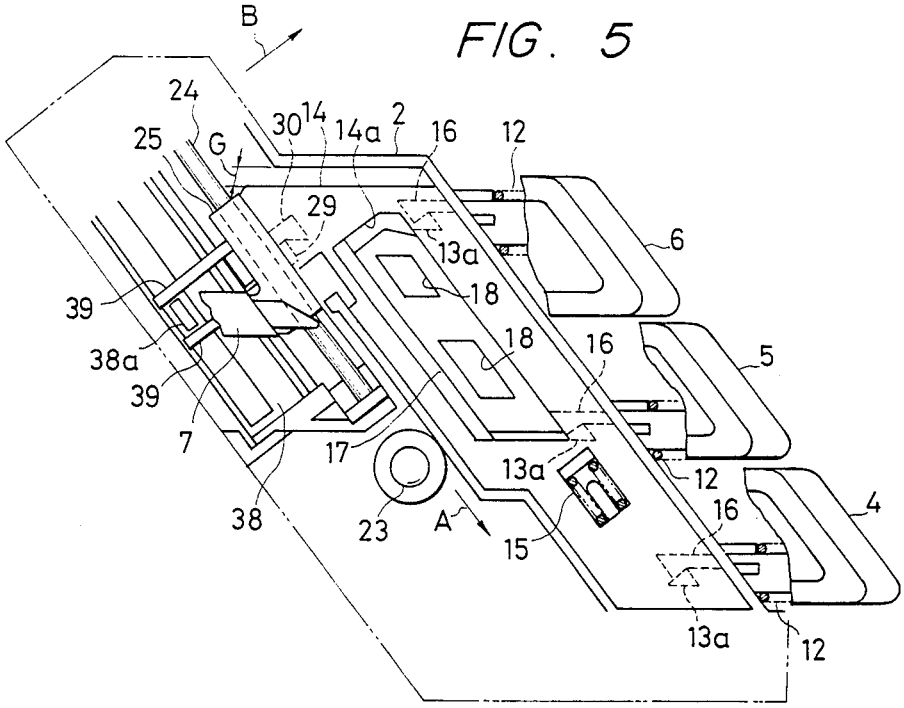
FIG. 5 is an elevational view partly broken away.

Locking construction for holding the depressed operating elements 4~6 will subsequently be described. As shown in FIG. 5, a lock plate 14 located on this side of the mounting lever 9 of each of the operating elements 4~6 is installed in the switch case 2. The lock plate 14 is contained in the switch case 2 with fixed gaps G above and under the plate and made diagonally movable in the vertical direction and normally energized by the compression spring 15 unidirectionally, i.e., in the direction of arrow A (diagonally downward). A mating means 16 is projected from a portion of the rear face of the lock plate 14, the portion thereof corresponding to the front end of each mounting lever 9. The mating projection 13*a* of the contact holder 13 interlocking with each of the operating elements 4~6 is allowed to mate with the mating means 16. In other words, when, e.g., the third operating element 6 is pressed down, the contact holder 13 is moved to the left of FIG. 1 and the mating projection 13*a* of the contact holder 13 simultaneously presses the mating means 16 of the lock plate 14, causing the lock plate 14 to move in the direction opposite to arrow A of FIG. 5 (diagonally upward). Then the mating projection 13*a* of the contact holder 13 passes by the left-hand side of the mating means 16 of the lock plate 14 and the lock plate 14 is simultaneously caused to return in the direction of arrow A by the elastic repulsive force of the compression spring 15. In consequence, the mating projection 13*a* of the contact holder 13 is prevented by the mating means 16 of the lock plate 14 from returning to the right. The third operating element 6 is thus kept in the depressed position. When either operating element 4 or 5 is pressed down while the third operating element 6 is maintained in the depressed position, the mating projection 13*a* of the contact holder 13 corresponding to the depressed operating element presses the mating means 16 of the lock plate 14 in the direction opposite to which it has been energized, i.e., in the direction opposite to arrow A against the elastic repulsive force of the compression spring 15. Consequently, the mating projection 13*a* corresponding to the third operating element 6 is unlocked and the third operating element 6 is returned to the original position by the elastic repulsive force of the compression spring 12. A double-push check plate 17 is installed in an opening 14a formed in the lock plate 14 and made diagonally movable in the vertical direction. The length covered by the moving double-push check plate 17 is set slightly greater than the distance between the mating projection 13*a* of the second operating element 5 and the mating projection 13*a* of the third operating element 6. When both operating elements 5, 6 are simultaneously operated, accordingly, each of the mating projections 13*a*, 13*a* is caused to abut against the double-push check plate 17 and prevent both operating elements 5, 6 from moving in the depressed position. Two circuits corresponding to both operating elements 5, 6 are thus prevented from being simultaneously closed.

Figure 4:
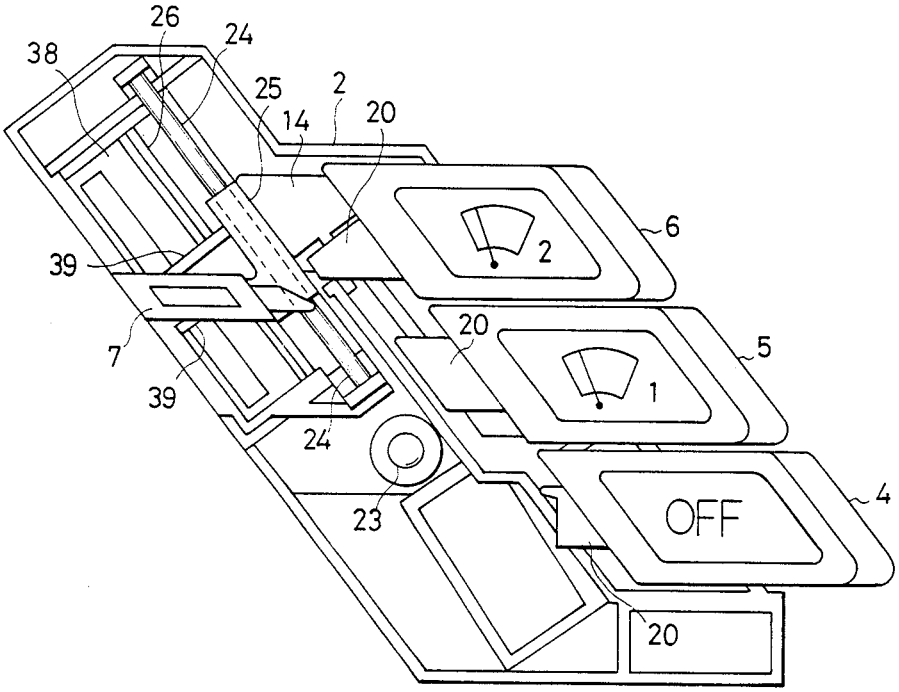
FIG. 4 is an elevational view without a switch cover.

Two through holes 18 are formed in the double-push check plate 17, whereby the light derived from a lamp 19 (see FIG. 1) as a light source in the switch case 2 for providing ON illumination is allowed to penetrate through the holes so as to be viewed by the driver of the automobile. On the other hand, a transparent plastic light guide 20 is inserted into each of the operating elements 4~6 in such a manner as to be buried in the display means 10. The left end of the light guide 20 is projected from each of the operating elements 4~6 and located in front of the double-push check plate 17. An opening 21 is formed in the display means 10 of each of the operating elements 4~6 and a translucent film 22 is stuck in such a manner as to cover the opening 21, which is used as an ON display means as well as a night display means. Of the three light guides 20, those corresponding to the second and third operating elements 5, 6 are respectively provided with V-shaped grooves 20*a*, 20*a* in positions located opposite to the through holes 18 of the double-push check plates 17 when the operating elements 5, 6 are put in the depressed position (see FIG. 3). In the switch case 2, moreover, a lamp 23 for night illumination is arranged in the left front position of each light guide 20 (see FIG. 4) and lit simultaneously when a small lamp of the vehicle is lit at night and the lamp 19 for providing night illumination is caused to light when one of the second and third operating elements 5, 6 including the operating knob 7, which will be described later, is pressed down. When the lamp 23 for night illumination is lit, the light emitted from the lamp 23 penetates into each of the three light guides 20 through its front end and illuminates each translucent film 22, thus enabling the user to distinguish the position of each operating element 4~6. When one of the second and third operating elements 5, 6 is pressed down, the operating element is moved up to the depressed position and light the lamp 19 for ON illumination, whereby the V-shaped groove 20*a* of the light guide 20 is located opposite to the through hole 18 of the double-push check plate 17. The light sent out of the lamp 19 for ON illumination is reflected from the V-shaped groove 20*a* and allowed to penetrate into the light guide 20 and illuminate the translucent film 22. In consequence, the user can recognize the ON state of the contact corresponding to the operating element involved. When the operating elements 5, 6 are pressed down while the translucent films 22 of the operating elements 4~6 are illuminated by the lamp 23 for night illumination, the light derived from the lamp 19 for ON illumination is added to the light from the lamp 23 for night illumination and the translucent film 22 is further brighly illuminated, so that the ON state of the contact becomes readily confirmable.

Figure 6:
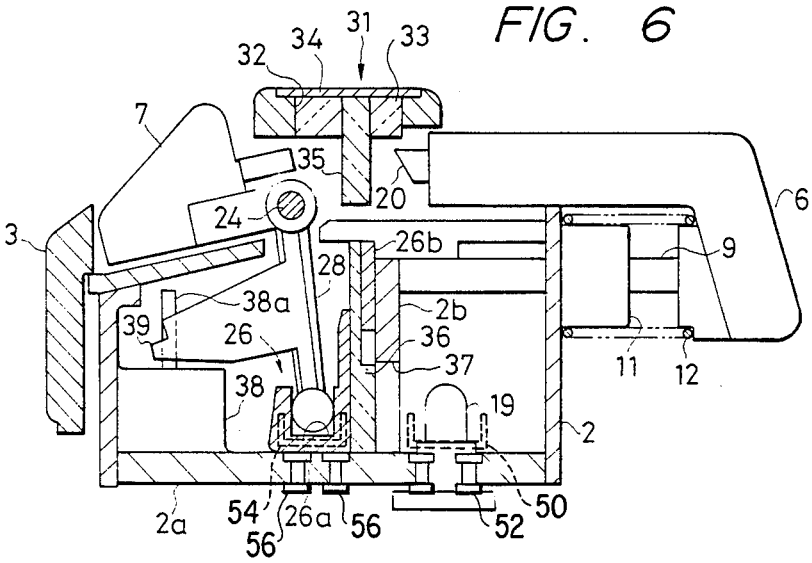
FIG. 6 is a transverse sectional view showing an operating knob in the depressed state.

The peripheral structure of the operating knob 7 will subsequently be described. As shown in FIGS. 1 through 4, a guide shaft 24 is erected diagonally in the vertical direction of the switch case 2. The guide shaft 24 is passed through a support tube 25 so as to support the operating knob 7 movably along and rotatably on the guide shaft 24 thereby. In the switch case 2 is installed a contact holder 26 displaceable in the direction perpendicular to the guide shaft 24, the contact holder 26 being normally energized toward the left of FIG. 1. by a compression spring 27 installed between a vertical partition 2*b* in the switch case 2 and the contact holder 26. The moving contact 54 is arranged on the under surface of the contact holder 26 in such a manner that it is attachable to and detachable from a contact 56 mounted on the insulator plate 2*a* of the switch case 2 as the contact holder 26 displaces. The operating knob 7 is equipped with an actuating means 28 or arm projected therefrom and extending toward the above contact holder 26, the front end of the actuating means or arm 28 being fitted into a mating groove 26a formed in the contact holder 26. The mating groove 26a extends along the guide shaft 24, thus allowing the operating knob 7 to freely move along the guide shaft 24 and no displacement of the contact holder 26 occurs. However, relative to the swiveling of the operating knob 7 on the guide shaft 24, the displacement of the contact holder 26 from the state shown in FIG. 1 to what is shown in FIG. 6 takes place. As shown in FIG. 5, moreover, a mating projection 29 is projected from the upper end of the side wall 26b of the contact holder 26, whereas a mating means or projection 30 is projected from the lock plate 14 in a position cooresponding to the mating projection 29. When the operating knob 7 is pressed down and swiveled on the guide shaft 24, the contact holder 26 is displaced in the direction of arrow B of FIG. 5 and the mating projection 29 is caused to press the mating means 30 of the lock plate 14 and move the lock plate 14 in the direction opposite to arrow A. Then the mating projection 29 is allowed to pass by the mating means 30 and the lock plate 14 is moved back by the elastic repulsive force of the compression spring 15 in the direction of arrow A. The mating projection 29 of the contact holder 26 is locked by the mating means 30 of the lock plate 14 and the contact holder 26 is held in a state shown in FIG. 6, whereby the operating knob 7 is held in the depressed position shown therein.

An ON display means 31 for the intermittent wiper as shown in FIG. 2 is installed close to the operating knob 7 on the switch cover 3 and, as shown in FIG. 1, a transparent plastic light guide 33 is provided in an opening 32 formed in a fixed position of the switch cover 3 and a translucent film 34 is stuck on the surface of the light guide 33 provided with a light guide pin 35 equivalent to a light receiving means, the light guide pin 35 being fitted in a fixed position of the light guide 33 with the bottom up. On the other hand, a vertically extended light guide 36 is buried in and fixed to the side wall 26b of the contact holder 26 (see FIG. 6). The light guide 36 having the exposed lower end portion is located opposite to a through hole 37 formed in the partition 2b of the switch case 2, whereas its upper end portion is upwardly exposed. When the operating knob 7 is pressed down to cause the contact holder 26 to displace toward the right as shown in FIG. 6, the lower end portion of the light guide 36 of the contact holder 26 communicates with the through hole 37 of the partition 2b, whereas the upper end portion of the light guide 36 is located right under the light guide pin 35. The light derived from the lamp 19 for ON illumination is passed through the through hole 37 and irradiates the light guide pin 35 through the light guide 36 of the contact holder 26 and illuminate the translucent film 34 of the ON display means 31. The user can thus confirm the ON operation executed. The light guide 33 is provided with a light receiving means (not shown) projected therefrom in the position opposite to the lamp 23 for night illumination and not only the light guide 33 but also the translucent film 34 is illuminated by the lamp 23 when it is lit.

A linearly operating variable resistor 38 shown in FIG. 1 is fixed to the switch case 2 with its turned-up operating element 38a and linearly operable along the extension of the guide shaft 24. The operating knob 7 incorporates a pair of coupling pieces 39, 39 projecting from its actuating means 28 and mates the operating element 38a with the projected coupling pieces 39 by positioning the operating element 38a of the variable resistor 38 between the projected coupling pieces 39. When the operating knob 7 is moved along the guide shaft 24, the operating element 38a of the variable resistor 38 is moved to make variable the resistance of the variable resistor 38, whereby the intermittent time interval at which the intermittent wiper is operated can be adjusted.

When the operating knob 7 is pressed rearward in a desired position in the switching device thus constructed, the contact holder 26 interlockingly displaced in the direction of arrow B of FIG. 5. The mating projection 29 of the contact holder 26 accordingly presses the mating means 30 of the lock plate 14 to move the lock plate 14 tentatively in the direction opposite to arrow A, whereby the operating knob 7 is held in the depressed position since the mating projection 29 mates with the mating means 30 (see FIG. 6). In consequence, the moving contact of the contact holder 26 and the fixed contact of the insulator plate 2a make contact with each other as prescribed and the intermittent wiper circuit is actuated thereby. Moreover, when the operating knob 7 in that state is moved diagonally in the vertical direction along the guide shaft 24, the operating element 38a moves in the same direction as that of the operating knob 7, causing the resistance of the variable resistor 38 and thus the interval at which the intermittent wipe is operated to change since the coupling pieces 39, 39 of the operating knob 7 mate with the operating element of the variable resistor 38 in such a manner as to sandwich them. The actuating means 28 of the operating knob 7 is then kept inserted in the mating groove 26a of the contact holder 26. However, the operating knob 7 is allowed to move freely since the mating groove 26a is extended along the direction in which the guide shaft 24 is extended and the state in which the contacts have been joined is not altered because the contact holder 26 does not displace. Even when the operating knob 7 is pressed down after it is moved to a desired position, the variable resistor 38 and the contact holder 26 are needless to say caused to operate independently of each other.

As set forth above, since the linearly operating variable resistor and the contact holder are operated independently of each other, an excellent practical effect is produced thereby in that the same operating knob can be employed for opening and closing the switches by making use of the easy-to-use properties of the linearly operating variable resistor.

What is claimed is:

1. A switching device having a linear variable resistor comprising:

a switch case having a bottom surface and sidewalls extending therefrom, and a guide shaft longitudinally mounted in said sidewalls;

an operating knob, having an aperture therein, rotatably mounted on and linearly movable along said guide shaft when said guide shaft is inserted through said aperture, said knob having an actuating arm extending substantially perpendicularly relative to said guide shaft, said switching device being alternatively activated and deactivated by rotational movement of said arm about said guide shaft;

a holder having movable contact means positioned therein, said holder being movably mounted in said switch case, and fixed contact means, positioned below said movable contact means in said bottom surface of said switch case, for selectively activating and deactivating the switching device as said movable contact means is brought into and out of connection with said fixed contact means, said holder having a longitudinal groove configured therein to accommodate the distal end of said actuating arm of said operating knob and to permit linear slidable movement of said actuating arm in said groove, said holder being movable between a first and second position to selectively activate and deactivate said switching device by rotation of said operating knob and said actuating arm about said guide shaft to bring said movable contact means into and out of connection with said fixed contact means;

said linear variable resistor having an operating element, linearly movable relative to the central axis of said guide shaft, for selectively adjusting said linear variable resistor; and coupling means, extending from said actuating arm of said operating knob, for mating with said operating element of said resistor to linearly move said operating element relative said guide shaft and selectively adjust the resistance of said resistor as said actuating arm of said operating knob is linearly moved along said guide shaft and said groove of said holder.

* * * * *